United States Patent [19]

Brown et al.

[11] Patent Number: 4,534,603

[45] Date of Patent: Aug. 13, 1985

[54] ASSEMBLY OF A CONTACT SPRING AND WIRE WRAP TERMINAL

[75] Inventors: Vincent B. Brown, Prospect Heights; Lawrence Geib, Elmwood Park, both of Ill.

[73] Assignee: Methode Electronics, Inc., Chicago, Ill.

[21] Appl. No.: 498,058

[22] Filed: May 25, 1983

[51] Int. Cl.[3] ..... H01R 4/09; H01R 13/15

[52] U.S. Cl. ..... 339/17 C; 339/221 R; 339/258 R; 339/262 R

[58] Field of Search ..... 339/17 C, 255 R, 256 R, 339/258 R, 259 R, 262 R, 220 R, 220 T, 221 RM, 252 R, 252 S, 258 RR, 262 RR, 276 A, 217 S, 258 P

[56] References Cited

U.S. PATENT DOCUMENTS

| | | | |
|---|---|---|---|
| 3,317,887 | 5/1967 | Henschen | 339/256 R |
| 3,748,634 | 7/1973 | Barnes et al. | 339/258 R |
| 3,760,340 | 9/1973 | Friend | 339/262 R |
| 3,784,965 | 1/1974 | Murphy | 339/262 R X |
| 3,998,518 | 12/1976 | Mathe | 339/221 R X |
| 4,415,212 | 11/1983 | Depillo | 339/17 C |

*Primary Examiner*—Gil Weidenfeld
*Assistant Examiner*—Steven C. Bishop
*Attorney, Agent, or Firm*—Charles F. Pigott, Jr.

[57] ABSTRACT

An assembly of a contact spring and a wire wrap terminal whereby the contact spring has a socket in which the pin of a suitable electrical device may be inserted. The terminal includes a wrappable wire end to make a connection with an electrical circuit. The contact spring and wire wrap terminal are stamped and formed as two separate pieces to be assembled together for use in a printed circuit board and the like. The contact spring may be formed from a different material than the wire wrap terminal. The assembly is fabricated in a manner to insure proper orientation of the spring when inserted into a board. Gold plating or the other expensive highly conductive materials may economically be applied to selective areas, because the contact spring is formed from flat stock material.

11 Claims, 20 Drawing Figures

ASSEMBLY OF A CONTACT SPRING AND WIRE WRAP TERMINAL

BACKGROUND OF THE INVENTION

This invention relates in general to electrical socket terminals and, in particular, to an assembly of a contact spring and wire wrap terminal.

More specifically, without limitation to the particular use which is shown and described, this invention relates to a contact spring clip and wire wrap terminal, comprising a two-piece construction which is fabricated from separately stamped and formed flat stock. The material of the spring may differ from the wire wrap terminal for increased economy and enhanced service characteristics. Expensive metal plating to increase contact may be selectively applied to the contact elements for added economy in manufacture.

Socket terminals are commonly employed to interconnect electrical devices with a circuit. The pins of the component may be plugged directly into the terminal for an effective connection. The terminal can be directly mounted on a circuit board or by use of a socket assembly and has a terminal end for interconnections with the electrical circuit by soldering and/or wire wrap techniques. In the prior designs, one type of socket terminal is a one piece device constructed from a single material. A one piece component suffers from several deficiencies, including the fact that the necessity of using only one material in its construction makes it more expensive to manufacture, because of the high cost of heavily plating the entire terminal.

In use, it is advantageous that the inner contact be formed from a flexible, high conductive material, such as copper and the like, while the socket terminal may be brass or any other material. Such flexibility is severely limited in a one piece design of the contact and terminal, since a single material is required. Typical techniques of manufacturing one piece sockets for circuit boards also generally result in a high profile of the contact, meaning the pin or contact projects too far up from the voltage plane side of the traditional printed circuit board. In use, such a high profile is disadvantageous from design considerations.

To solve the problems presented by one piece sockets, certain terminals have been introduced employing a two-piece design where the contact and the terminal are constructed from different materials offering better performance characteristics and less fabrication expense, depending on the function of the element within the assembly. Known two-piece socket designs, however, have disadvantageously been heretofore machined in manufacture. The necessity to precision machine such two-piece assemblies decreases the overall economy of fabrication of the terminal. The cost of manufacture of prior two-piece designs is also increased by requirement that gold plating, or the application of other conductive materials, must be made to the entire surface of the contact area, because selective plating of machined components is extremely difficult. Known two-piece designs of the machined type are further deficient in providing accurate orientation of the terminal when mounted on the board. It is advantageous that the contact spring tines be aligned with the flats on the socket terminal which, in turn, assures the four tines of the spring contact mates with both the sides and edges of the leads of the plug-in active device when the assembly is properly inserted into a socket or printed circuit board.

SUMMARY OF THE INVENTION

It is, therefore, an object of the present invention to provide an improved two-piece contact spring and wire wrap terminal assembly.

Another object of the present invention is to provide a two-piece assembly for a spring contact and a wire wrap terminal which may be fabricated from a flat stock.

A still further object of this invention is to provide a contact spring and wire wrap terminal in which the extent of applying expensive conductive material for enhanced electrical contact is minimized.

A still further object of this invention is to provide a contact spring and wire wrap terminal assembly capable of being fabricated from more than one material to meet design considerations.

A still further object of this invention is to align the orientation of the wrappable terminal ends mounted on a circuit board.

These and other objects are attained in accordance with the present invention wherein there is provided an improved assembly of a contact spring and wire wrap terminal which may be used in connection with a conventional circuit board or socket for interconnecting an I.C. component and the like with an electrical circuit, such as in a computer. The contact spring and wire wrap terminal are separately fabricated from flat stock in an economical manner through stamping and forming operations, such that each element may be made from different materials and separately heat treated depending on desired results and cost considerations. Moreover, gold plating or the application of other conductive metals may be localized to needed areas, since the plating operation may be performed on the flat stock before forming, a technique not possible in known two-piece designs which are machined in screw machines and the like. The assembly of the contact spring and wire wrap terminal of the invention is capable of being inserted through the holes of a circuit board in proper orientation with other terminals for ease of interconnection in the circuit.

BRIEF DESCRIPTION OF THE DRAWINGS

Further objects of the invention together with additional features contributing thereto and advantages accruing therefrom will be apparent from the following description of the preferred embodiments of the invention which are shown in the accompanying drawings with like reference numerals indicating corresponding parts throughout, wherein.

DESCRIPTION OF THE PREFERRED EMBODIMENTS

Figure 1:
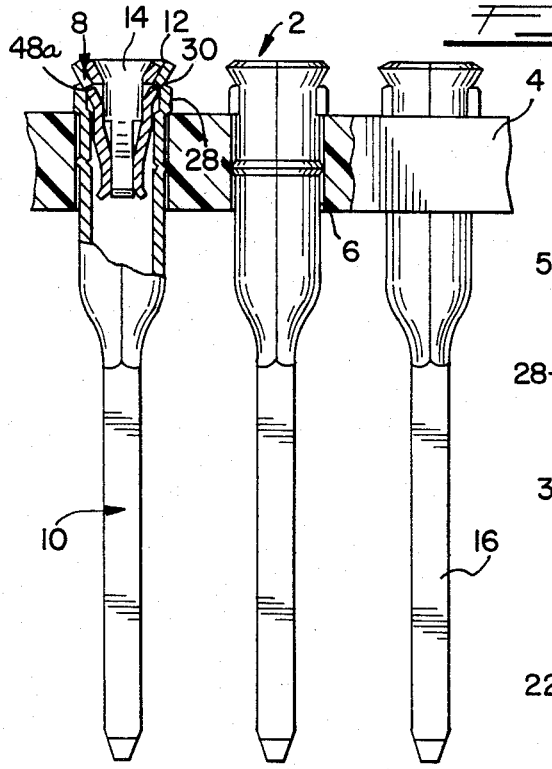
FIG. 1 is a side view, with parts in sections, of the assembly for a contact spring and wire wrap terminal of the invention.

Referring now to FIG. 1, there is illustrated a plurality of assemblies of the invention, generally designated by the reference numeral 2, and shown mounted on a conventional printed circuit board 4 within respective terminal openings 6 provided therein, or in a socket insulator (not shown). Each assembly 2 comprises an upper contact spring 8 and a lower terminal 10 of the wire wrap type. The contact spring 8 is mounted within the upper opening 12 of the terminal 10, and the spring, in turn, forms an open end 14 which acts as a socket for receiving a respective connector pin of a typical I.C. component and the like. The lower end of the terminal 10 is provided with an end portion 16 having a plurality of flat sides and being capable of being interconnected with an electrical circuit by a wire wrap technique as is well-known in the art.

Referring now to FIGS. 2 to 5, details of the wire wrap terminal 10 of the assembly 2 of FIG. 1 are illustrated. The wire wrap terminal 10 may be fabricated from any suitable conductive material, such as, for example, brass and other metal, and preferably has a finish of gold or tin plating and the like where desirable in use. The wire wrap terminal 10 is manufactured in accordance with the invention through stamping and forming operations, such as by an example of a method to be described later.

Figure 2:
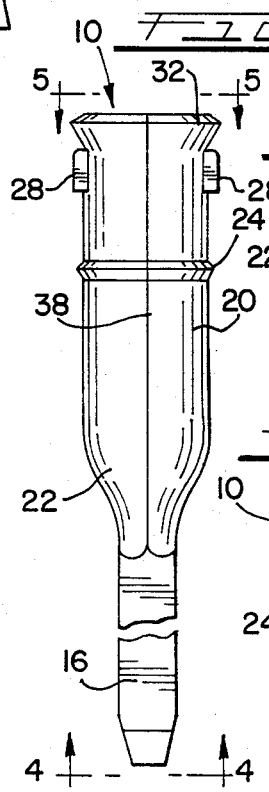
FIG. 2 is a side view of the wire wrap terminal of the assembly of FIG. 1.
Figure 5:
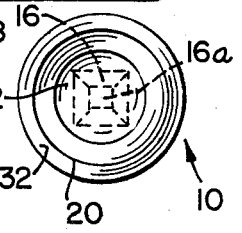
FIG. 5 is a top view taken along line 5—5 of FIG. 2.
Figure 4:
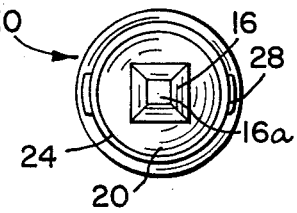
FIG. 4 is an end view taken along line 4—4 of FIG. 2.
Figure 3:
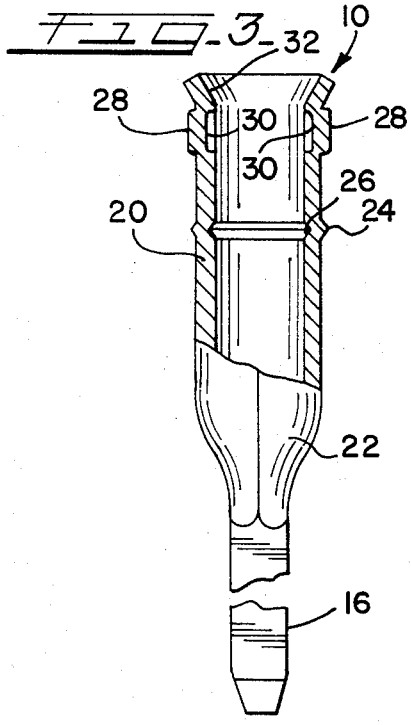
FIG. 3 is a side view, with parts in section, of the wire wrap terminal of FIG. 2 without the contact spring.

The lower end portion 16 is formed as a stamped solid body having a substantially square cross section and having an end 16*a* as best shown in FIGS. 4 and 5. The upper end of the terminal 10 possesses an enlarged, circular body 20 which interconnects with lower end portion 16 at a transitional tapered section 22. The upper portion 20 is adapted to be mounted within a respective hole 6 of the circuit board 4. The outer periphery of portion 20 is provided with an outward, circumferentially extending projection 24 formed by bulging the sidewalls of the cylinder 20 outward and to create a continuous ring which acts as a retention member when the terminal is inserted into opening 6 of the terminal board or a socket insulator. As shown in FIGS. 2 and 3, a pair of diametrically opposed tabs 28 are positioned near the upper end of upper portion 20. The tabs are provided by being pressed out during forming in a manner that a pair of opposed notched areas 30 are also provided on the interior wall above ring 26. The upper end 32 of the terminal flares outward to aid in the assembly of the contact spring with the terminal 10. The bottom of the tabs 28 acts as stops which contact the circuit board after insertion of a terminal therein as shown in FIG. 1.

Figure 6:
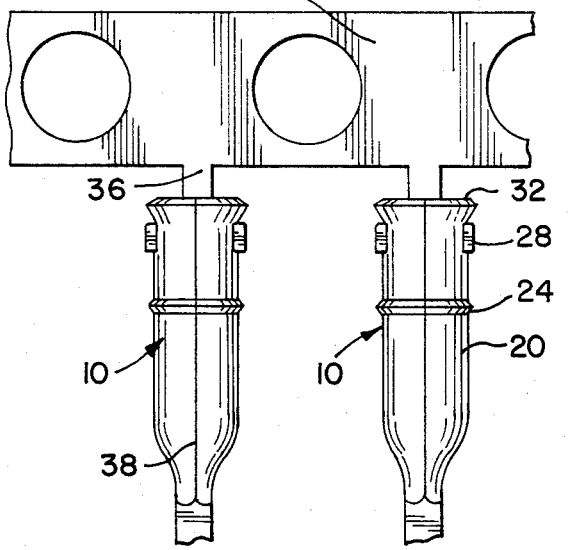
FIG. 6 is a partial view of a plurality of wire wrap terminals of FIG. 2 being formed from flat stock material and shown after stamping and forming operations.
Figure 7:
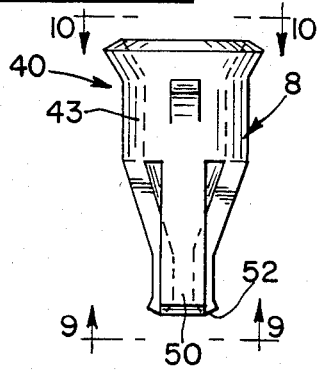
FIG. 7 is a front view of the contact spring of the assembly of FIG. 1.
Figure 8:
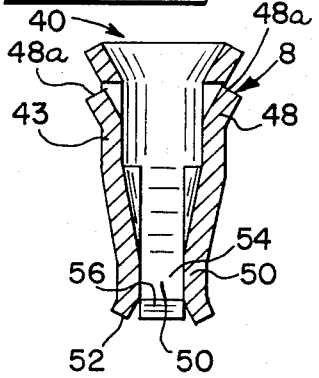
FIG. 8 is a side sectional view of the contact spring of FIG. 7 rotated by 90° about its longitudinal axis.

In the manufacture of the terminal 10, flat stock material is fed to conventional stamping and forming machines to stamp and form the terminal into the configuration of FIGS. 2 and 3. While such operations are performed attached to an elongated portion 34 of the stock strip, the terminal is formed having a plurality of such terminals 10 supported thereon in equal spacing by a strip 36 as shown in FIG. 6. The equal spacing of the terminals 10 on stock portion 34 which has been corrugated, facilitates the manufacture of the terminal, its assembly with the contact spring, and insures that the terminals are inserted with accurate, uniform orientation into the circuit board. In one method of manufacture, the strip portion 34 may be severed from the respective terminals 10 by suitable means upon their insertion into the terminal board as will be apparent. Because the hollow structure is manufactured from a flat stock by forming operations, a seam 38 having a minimal separation is created during its fabrication.

Figure 20:
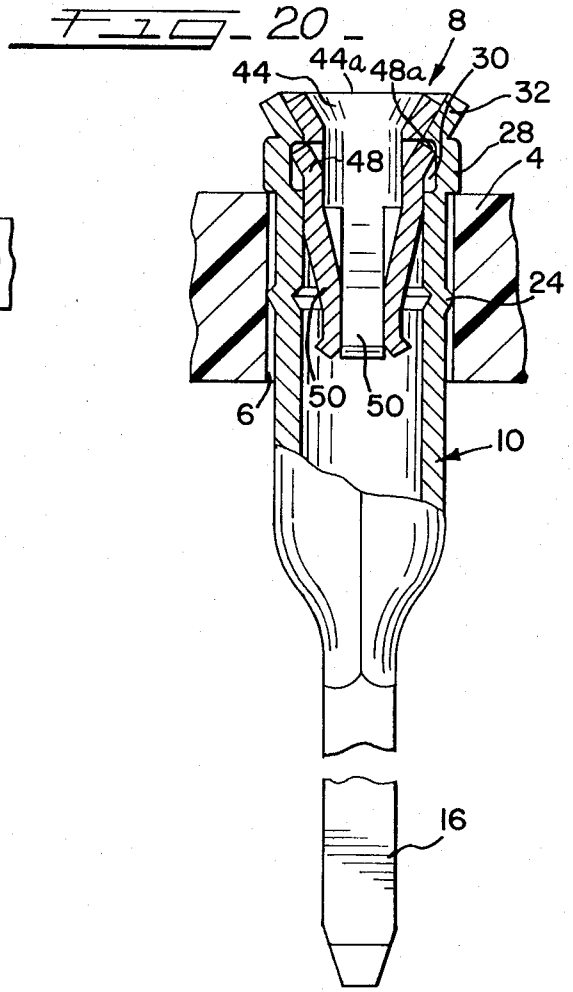
FIG. 20 is an enlarged view of the assembly for the contact spring and wire wrapped terminal, with parts in section, showing the mounting of the assembly on the board for proper orientation.
Figure 19:
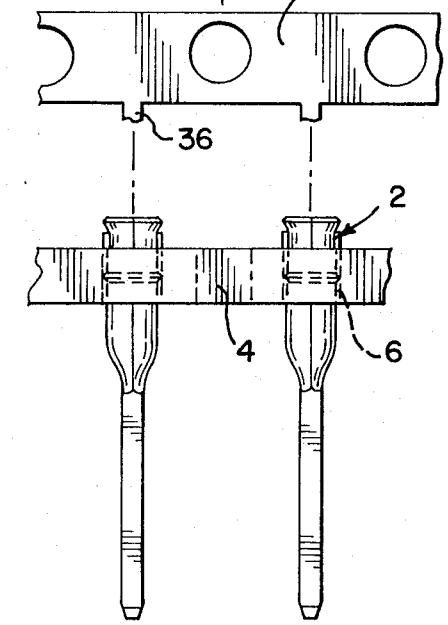
FIG. 19 is a side view illustrating the removal of the waste material from the terminal forming strip and showing the assembly of FIG. 1 in a mounted position on the circuit board.
Figure 18:
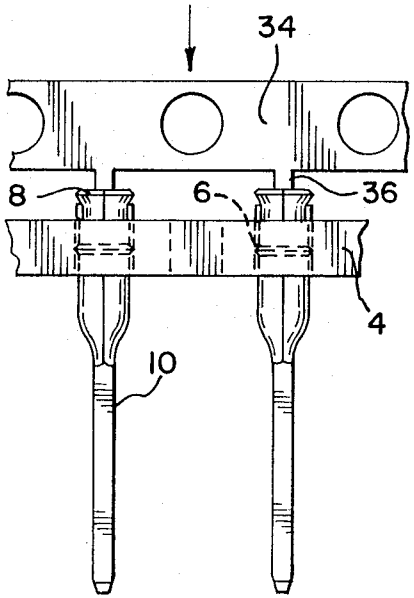
FIG. 18 is a side view showing the step of inserting the assembly of the contact spring and and wire wrap terminal into a respective terminal receiving holes of a circuit board prior to removal of scrap from the strip from which the terminal was formed.

Referring now to FIGS. 7 to 10 and 14, there is illustrated the contact spring 8 of the assembly 2 shown in FIG. 1. As was terminal 10, the contact spring is preferably manufactured through stamping and forming operations by suitable equipment (not shown) from a flat stock of metal, such as supplied by a reel of material. The contact spring 8 is arranged to be positioned in the upper end 32 of the terminal 10 as best illustrated in FIGS. 1 and 20. The contact spring 8 comprises a one piece conductive body 40, which, through forming operations using dies and the like, has a closed seam 42 (FIG. 14) and an upper portion 43 of a generally circular configuration. The flared upper end 44 of the body 40 forms an upper socket opening 44*a* to receive the male pin of an electrical component to be mounted on the circuit board 4.

The shape of flared upper end 44 is designed to lie in matching relationship with the upper end 32 of the terminal 10 in an assembled form (FIG. 20). A pair of diametrically opposed tabs 48 are cut out from the body 40 and form upper edges 48*a* adapted to engage the notch areas 30 existing within the terminal 10, as best shown in FIGS. 1 and 20. Four separate contact fingers 50 taper downward from upper portion 43 and terminate with a flared end 52. Each of the fingers 50 extend inward toward each other to define a generally rectangular opening 54 in which an end portion of the pin, preferably of the flat type (not shown), of an I.C. component is inserted. The fingers 50 resiliently engage the pin to retain the lead within the spring and attain electrical contact. The internal area 56, where the pin of the I.C. component contacts fingers 50 at opening 54, may be selectively plated with a highly conductive metal capable of making a superior connection between the elements. Although contact clip 8 may be manufactured from any suitable metal, a copper alloy having good conductivity properties can be satisfactorily employed with a stripe of gold being applied to the internal contact area 56 of the fingers 50.

Figure 14:
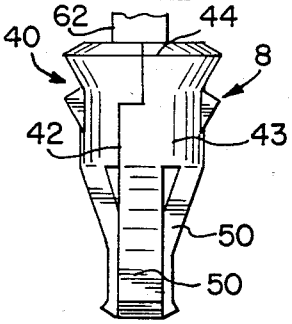
FIG. 14 is a side view of the contact spring of FIG. 7 after forming rotated by 90° about its longitudinal axis.
Figure 9:
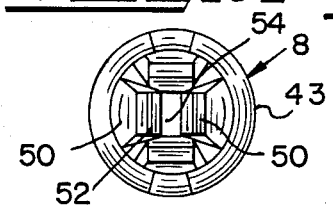
FIG. 9 is a bottom end view taken along line 9—9 of FIG. 7.
Figure 10:
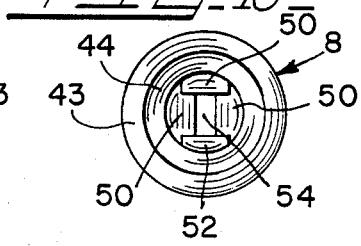
FIG. 10 is a top end view taken along line 10—10 of FIG. 7.
Figure 12:
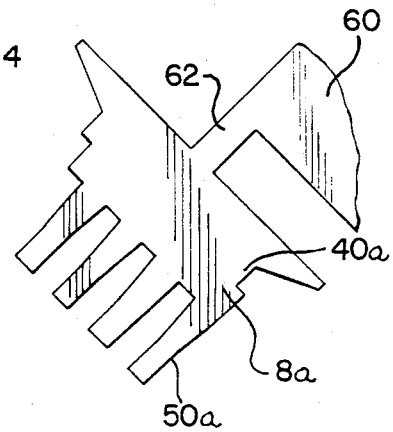
FIG. 12 is a partial enlarged view of the unformed stamped contact spring of FIG. 11.
Figure 11:
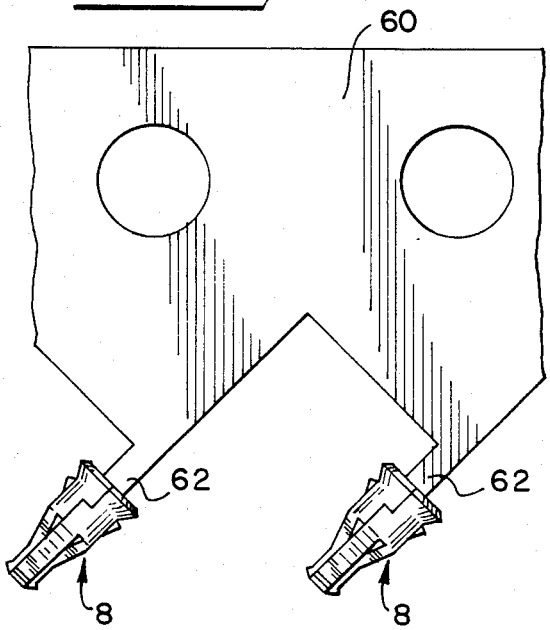
FIG. 11 is a partial view of stock having a plurality of contacts being formed showing two contacts in a formed shape.
Figure 13:
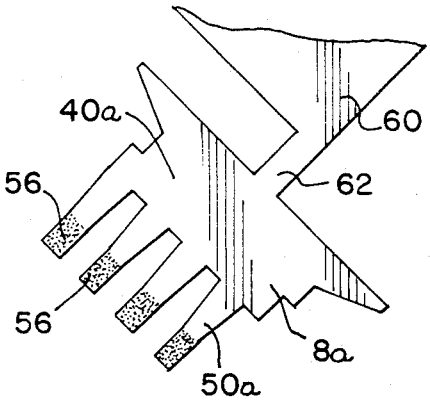
FIG. 13 is a partial side view of the opposite side of the contact spring of FIG. 12, showing the side forming the inside of the contact.

Referring now to FIGS. 11–14, illustrative steps of the stages of manufacture of the contact spring of the invention, by stamping and forming, are shown as one method of manufacture, although other techniques of fabricating the assembly of the invention may be used. The spring 8 may be formed from a flat strip of stock material which conveniently can be supplied from a reel and fed to a stamping machine of standard design. Within the stamping machine, a plurality of patterns 8*a* of flat configuration may be established from the stock, each of which is symmetrically attached to scrap portions 60 by a strip 62 as in FIGS. 12 and 13. Patterns 8*a* include a main portion 40*a* and four, spaced finger projections 50*a* which, after forming, are transformed into fingers 50 in the final configuration. As shown in FIG. 13, gold or other plating can be selectively applied to the contact areas 56 of fingers 50 while the pattern 50*a* is still flat in strips. Thus, the entire contact spring 8 does not have to be immersed into a gold plating solution and the like as in the prior art where expensive plating materials are not conserved. In FIGS. 11 and 14, the final form of contact springs 8 is shown after they have gone through a forming machine subsequent to the flat pattern being established at the stage shown in FIG. 12. The plurality of contact springs 8 are maintained in a predetermined spaced and symmetrical relationship by continuous scrap portion 60.

Figure 15:
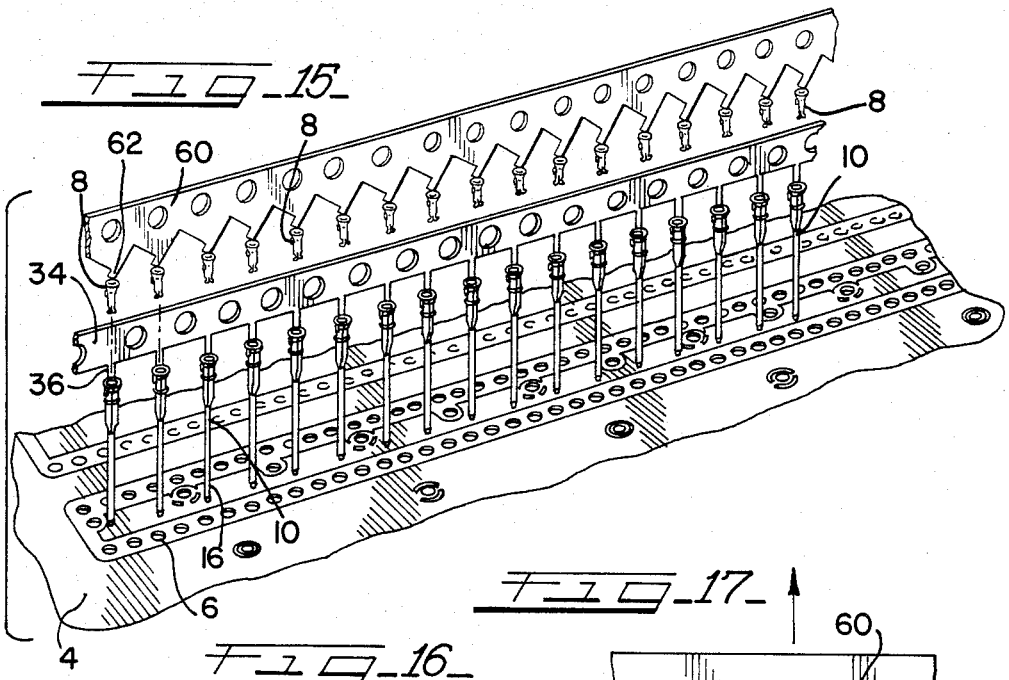
FIG. 15 is an exploded perspective view of a strip of contact springs and wire wrap terminals illustrated above a circuit board.

In FIG. 15, for purposes of understanding how the strips respectively containing the contact spring 8 and the terminal 10 can be easily assembled and readily handled, there is illustrated a strip of each in their respective forms of FIGS. 6 and 11 shown above the circuit board 6 prior to assembly or insertion. The spacing between terminals 10 on portion 34 equals, in turn, the desired spacing of the assembly on circuit board 6. In FIG. 15, the contact springs 8 are disposed at right angles to the strip portion 60 to align with the terminals 10. The particular angular orientation of the springs 8 and terminals 10 on the strips is dependent on the fabrication techniques, mounting and the like, and the contact spring clips can be fabricated at an angle on the strip as in FIGS. 12, 13 and 14 or projecting straight out or at 90° to the linear carrier of the strip. The spacing between each assembly 2 may be reduced by corrugation of the waste stock (not shown) to match hole spacing on the circuit board 6.

Figure 16:
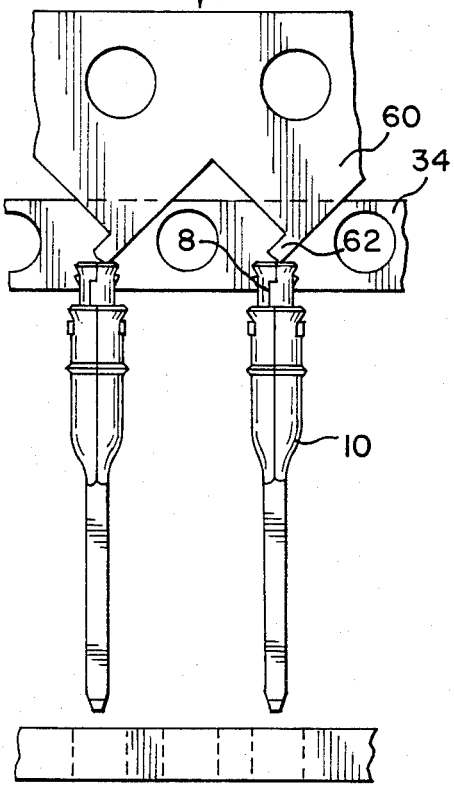
FIG. 16 is a front view of a step of inserting formed contact springs into the socket end of the wire wrapped terminals prior to the forming step thereof.
Figure 17:
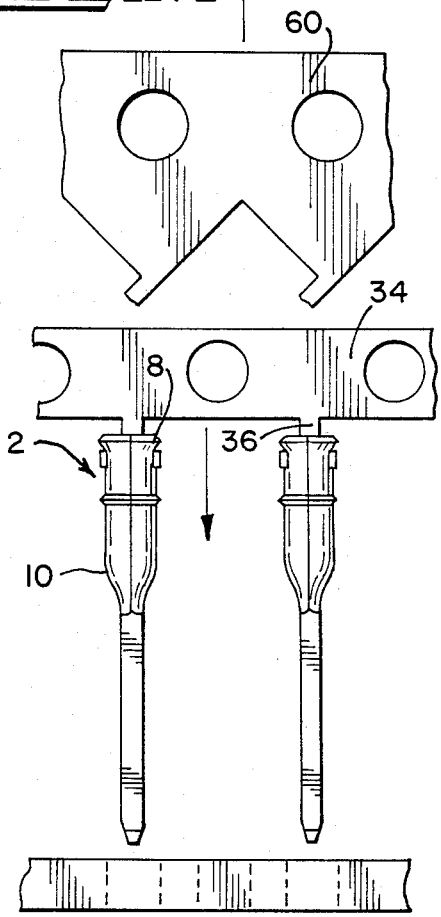
FIG. 17 is a step subsequent to the operation of FIG. 16 showing the completion of the forming of the socket of the wire wrapped terminal around the contact spring and the removal of the waste material from the strip from which the contact spring was formed.

In FIG. 16, the stamped and formed contact springs 8, shown in FIG. 14, are inserted through a proper mechanism into each of the socket ends 32 prior to the terminals 10 undergoing their final forming operation. The retention of the contacts 8 on strip 60 establishes proper spacing, and facilitates and maintains insertion into terminal 10 prior its final forming into the configuration of FIG. 6. The final formation of the terminals within the forming machine of known design thereafter can be performed to capture a respective contact spring 8 with the tabs 48 thereof being inserted into the recess 30 of terminal 10 to create the relationship shown in FIG. 20. In FIG. 17, the subsequent step is illustrated by which scrap 60 is severed by suitable means at strip 62 from the contact spring and terminal assembly, while scrap portion 34 is still retained.

As shown in arrows in FIG. 17, the assemblies 2 are then inserted through respective board holes 6 by suitable equipment or by hand with scrap portion 34 in tact. Proper orientation of contact spring and terminal is established by tab 48 and notch 30. Retention of scrap portion 34 during insertion facilitates handling during insertion and maintains proper spacing and orientation. After the assembly is inserted into the holes 6 of the board, the waste stock 34 may then be severed at strips 36 by a convenient technique with the result that the assembly is mounted in proper relationship on a P.C. board in the manner shown in FIG. 20. In the final relationship of FIG. 20, the continuous projection 24 centers terminal 8 within board opening 6, while tabs 28 contact the voltage side surface of the board.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A two-piece socket terminal assembly for a circuit board comprising:

a terminal member having an upper hollow body, a peripheral portion for mounting on a circuit board, and a lower terminal end, a contact spring having a hollow portion to form an upper pin receiving socket, said hollow portion being mounted within the opening of said hollow terminal body, said spring further including a plurality of resilient contact fingers extending from said hollow portion downward into said hollow body to engage a pin on an electrical component inserted therein, and said terminal portion and said contact spring being separately fabricated by stamping and forming techniques, said terminal portion also including a pair of opposed recesses positioned within said hollow body, said hollow portion of said spring having a pair of opposed, outwardly extending tabs, said tabs arranged to be inserted into said recesses for retaining said spring in said terminal and creating a proper orientation therebetween to insure mating with sides and edges of a plug-in electrical device, said pair of opposed recesses being formed by a punched out portion of said hollow body, said punched out portion forming an outer tab to aid in the mounting and support on a circuit board.

2. The socket terminal according to claim 1 wherein said hollow body and said hollow portion each include a closed seam created during forming operation.

3. The socket terminal of claim 1 wherein said plurality of fingers are arranged to resiliently engage a portion of the pin of the electrical component inserted into said contact spring, said fingers having an area thereof in contact with said pin and being selectively plated with a highly conductive metal.

4. The socket terminal of claim 3 wherein said highly conductive metal in said selected area of plating is applied while said contact spring is in a flat configuration prior to being formed in a hollow construction.

5. The socket terminal of claim 1 wherein said hollow body and said hollow portion each include complimentary contacting flared upper sections.

6. The socket terminal of claim 1 wherein said upper body is formed with a cylindrical cross-section and said terminal end has a substantially square configuration.

7. A two-piece socket terminal assembly for a circuit board comprising:

a terminal number having an upper hollow body, a peripheral portion for mounting on a circuit board, and a lower terminal end, said peripheral portion comprising an outwardly circumferentially extending projection formed by bulging of the sidewall of said upper hollow body to create a continuous ring to serve as a retention member when inserted into an opening of a terminal board and the like, a contact spring having a hollow portion to form an upper pin receiving socket, said hollow portion being mounted within the opening of said hollow terminal body, said spring further including a plurality of resilient contact fingers extending from said hollow portion downward into said hollow body to engage a pin of an electrical component inserted therein, said terminal portion including a pair of opposed recesses positioned within said hollow body, said hollow portion of said contact spring having a pair or opposed outwardly extending tabs, said tabs arranged to be inserted into said recess for retaining said spring in said terminal and creating a proper orientation therebetween to insure mating with sides and edges of a plug-in electrical device.

8. The socket terminal of claim 7 in which said hollow body of the terminal member and said hollow portion of the contact spring each include complementary contacting flared upward sections for mating together in retaining relation.

9. The socket terminal according to claim 7 in which said recesses are formed by a punched out portion of said hollow body, said punched out portion forming an outer tab to aid in the mounting and support on the circuit board.

10. The socket terminal of claim 9 in which said plurality of fingers are arranged to resiliently engage a portion of the pin of the electrical component inserted into said contact spring, said fingers having an area thereof in contact with said pin and being selectively plated with a highly conductive metal.

11. The socket terminal of claim 10 in which said highly conductive metal in said selective area of plating is applied while said contact spring is in a flat configuration prior to being formed in a hollow construction.

* * * * *